US005824939A

United States Patent [19]

Handelman

[11] Patent Number: 5,824,939

[45] Date of Patent: Oct. 20, 1998

[54] SYSTEM AND METHOD FOR DECEIVING ENEMY FORCES IN BATTLEFIELD

[75] Inventor: Doron Handelman, Givatayim, Israel

[73] Assignee: Dauphin Biotechnologies Promotion, Ltd., Herzlia, Israel

[21] Appl. No.: 720,453

[22] Filed: Sep. 30, 1996

[30] Foreign Application Priority Data

Dec. 28, 1995 [IL] Israel ..... 116597

[51] Int. Cl.[6] ..... F42B 4/18

[52] U.S. Cl. ..... 89/1.11; 102/513

[58] Field of Search ..... 89/1.1, 1.11, 7, 89/1.818, 1.3, 1.35, 1.701; 102/444, 445, 498, 499, 264, 266, 491, 497, 513, 214; 434/11, 14, 16, 19, 21–23, 27

[56] References Cited

U.S. PATENT DOCUMENTS

| | | | |
|---|---|---|---|
| 3,291,049 | 12/1966 | Hitchens | 102/513 |
| 3,374,741 | 3/1968 | Bass | 102/513 |
| 4,012,985 | 3/1977 | Magnusson | 89/1.3 X |
| 4,669,357 | 6/1987 | Von Laar et al. | 89/1.3 X |
| 4,709,614 | 12/1987 | Klumpp | 89/1.35 |
| 4,759,430 | 7/1988 | Kalin | 89/1.701 X |
| 4,782,757 | 11/1988 | Carter | 102/445 X |
| 5,094,168 | 3/1992 | Rumer . | |
| 5,119,715 | 6/1992 | Porter, Jr. et al. | 102/264 X |
| 5,186,628 | 2/1993 | Newman . | |
| 5,617,097 | 4/1997 | Gavnoudias | 102/214 X |

OTHER PUBLICATIONS

*Technologies,* vol. 52, May 1, 1988, p. 11.

International Defense Review, Jan. 1989, pp. 53–57, Countermeasures for tanks beating smart munitions.

Brochure from Diehl for Darkas 17 Canon Fire Simulator System, date unknown.

Military Technology, May 1987, p. 89, Two Ss from Sagem.

Official Gazzette page from Israeli Patent Office for Israeli patent 86110, Dec. 12, 1991.

*Primary Examiner*—Michael J. Carone
*Assistant Examiner*—Matthew J. Lattig

[57] ABSTRACT

A deception system for deceiving enemy forces including a launcher, and pyrotechnic ammunition which is launched from the launcher and exploded at a location away from the launcher, wherein the pyrotechnic ammunition includes: a detonation mechanism which is set to detonate at the location away from the launcher, and pyrotechnic explosive material which is detonated by the detonation mechanism. When the pyrotechnic explosive material is detonated, a muzzle flash effect is created, and the muzzle flash effect is substantially similar to a real muzzle flash.

33 Claims, 3 Drawing Sheets

SYSTEM AND METHOD FOR DECEIVING ENEMY FORCES IN BATTLEFIELD

FIELD OF THE INVENTION

The present invention relates generally to deception systems for deceiving enemy forces in battlefield, and more particularly to systems which deceive enemy forces about the tactical and strategical tendencies of military forces confronting them and about the number and location of the military forces.

BACKGROUND OF THE INVENTION

Most deception systems which are employed in battlefield for the purpose of creating illusions of military systems use two dimensional and three dimensional visual decoys. These decoys are made of light materials and are deployed by soldiers in the battlefield. Some of the decoys also include electrical heating elements which enable them to operate as thermal decoys as well.

Description of such decoys may be found in an article named "Countermeasures for Tanks—Beating Smart Munitions" by R. M. Ogorkiewicz in International Defense Review magazine 1/89, pp. 53.

Other types of decoys which may be found in battlefields are stationary frames of military battle tanks, artillery, various kinds of armor, battle ships, airplanes and helicopters. The frames are typically mounted on light military vehicles, such as jeeps, or on other supporters and are brought to certain locations which are visible to an enemy. In most cases the decoys are positioned in places in which the real systems are typically deployed. For example, battleship decoys are positioned in naval ports and helicopter decoys are positioned in airports.

Generally, the decoys have structures and colors that are identical to those of equivalent real military systems and are operated by an army in battlefield to deceive an enemy about the number and location of military systems of the army.

All these systems have to be deployed by soldiers in battlefield and therefore endanger the deploying forces. Moreover, such systems require transportation, to and from battlefield, and maintenance even after deployment. Another problem is that when the deploying forces advance, the decoys have to be disassembled and transported to new locations. In modern dynamic battlefields, where forces often change their positions, the deployment and disassembly of such decoys is slow and cumbersome. Therefore, the use of such decoys in modern battlefields is limited.

SUMMARY AND OBJECTS OF THE INVENTION

The present invention seeks to provide dynamic, easy to use systems and methods for deceiving enemy forces about the tactical and strategical tendencies of military forces confronting them and about the number and location of the military forces.

There is thus provided in accordance with a preferred embodiment of the invention a deception system for deceiving enemy forces including:

a launcher; and pyrotechnic ammunition which is launched from the launcher and exploded at a location away from the launcher, the pyrotechnic ammunition including:

a detonation mechanism which is set to detonate at the location away from the launcher; and pyrotechnic explosive material which is detonated by the detonation mechanism, wherein a detonation of the pyrotechnic explosive material is operable to create a muzzle flash effect which is substantially similar to a real muzzle flash.

Preferably, the muzzle flash effect is employed to decoy an enemy.

Yet preferably, the pyrotechnic ammunition is exploded at a pre-selected height above ground. The pre-selected height may be substantially similar to a height above ground of a launching barrel of a real military system which the pyrotechnic ammunition is employed to decoy.

In a preferred embodiment of the present invention the launcher is a mortar and the pyrotechnic ammunition is at least part of a mortar bomb.

Alternatively, the launcher includes one of a pneumatic mechanism, a hydraulic mechanism and a spring mechanism for launching the pyrotechnic ammunition.

In accordance with a preferred embodiment of the present invention the launcher includes a plurality of launching barrels for launching a plurality of the pyrotechnic ammunition.

Preferably, the launcher is mounted on a military vehicle. The military vehicle may include one of a military battle tank, an artillery carrying vehicle, a land armored vehicle, a ship, an airplane and a helicopter.

Alternatively, the launcher is a portable launcher which is carried by a soldier.

In accordance with a preferred embodiment of the present invention the launcher includes means for preventing creation of a muzzle flash during launch of the pyrotechnic ammunition.

In accordance with another preferred embodiment of the present invention the launcher is one of a grenade launcher, a rocket launcher, a smoke ammunition launcher, a cannon-gun launcher and a bomb launcher which is adapted to launch the pyrotechnic ammunition.

Preferably, the pyrotechnic ammunition is adapted to be launched from one of a grenade launcher, a rocket launcher, a smoke ammunition launcher, a cannon-gun launcher and a bomb launcher.

Further in accordance with a preferred embodiment of the present invention the detonation mechanism is a time mechanism which is set to detonate at the location away from the launcher by estimation of time of flight of the pyrotechnic ammunition.

Preferably, the detonation mechanism is a time mechanism which is set to detonate at the selected height above ground by estimation of time of flight of the pyrotechnic ammunition.

Alternatively, the detonation mechanism is a height mechanism which is set to detonate at the selected height above ground by setting a selected explosion height.

Preferably, the pyrotechnic ammunition also includes a detonation secure system.

In accordance with a preferred embodiment of the present invention the muzzle flash effect is employed to decoy cannon-gun firing.

In accordance with another preferred embodiment of the present invention an explosion of the pyrotechnic ammunition is employed to decoy hit and kill of a military system.

Preferably, the explosion of the pyrotechnic ammunition is symmetric and has no preferred direction.

In accordance with a preferred embodiment of the present invention the pyrotechnic ammunition includes at least one detonation fuse which is operable to substantially simultaneously ignite the pyrotechnic explosive material at more than one point to create a substantially symmetric explosion.

There is also provided in accordance with a preferred embodiment of the present invention a method for deceiving enemy forces including:

launching pyrotechnic ammunition from a launcher; and exploding the pyrotechnic ammunition at a location away from the launcher, the exploding including:

setting a detonation mechanism to detonate at the location away from the launcher; and detonating pyrotechnic explosive material by employing the detonation mechanism, wherein a detonation of the pyrotechnic explosive material is operable to create a muzzle flash effect which is substantially similar to a real muzzle flash.

Preferably, the method includes employing the muzzle flash effect to decoy an enemy.

Yet preferably, the exploding includes exploding the pyrotechnic ammunition at a selected height above ground.

In a preferred embodiment of the present invention the exploding includes exploding the pyrotechnic ammunition at a height which is substantially similar to a height above ground of a launching barrel of a real military system which the pyrotechnic ammunition is employed to decoy.

Preferably, the launching includes preventing creation of a muzzle flash when the pyrotechnic ammunition is launched.

In yet another preferred embodiment of the present invention the setting includes:

estimating time of flight of the pyrotechnic ammunition; and employing the estimated time of flight to activate the detonation mechanism when the time of flight elapses.

Alternatively, the setting includes:

setting an explosion height; and activating the detonation mechanism when the pyrotechnic ammunition reaches the explosion height.

Additionally, the method includes:

maintaining the pyrotechnic ammunition unarmed prior to the launching; and arming the pyrotechnic ammunition after the launching and prior to the exploding.

There is also provided in accordance with a preferred embodiment of the present invention pyrotechnic ammunition to be launched by a launcher including:

a detonation mechanism which is set to detonate when the pyrotechnic ammunition is at a location away from the launcher; and pyrotechnic explosive material which is detonated by the detonation mechanism, wherein a detonation of the pyrotechnic explosive material is operable to create a muzzle flash effect which is substantially similar to a real muzzle flash.

BRIEF DESCRIPTION OF THE DRAWINGS

The present invention will be understood and appreciated more fully from the following detailed description, taken in conjunction with the drawings in which.

DETAILED DESCRIPTION OF THE PREFERRED EMBODIMENTS

Figure 1A:
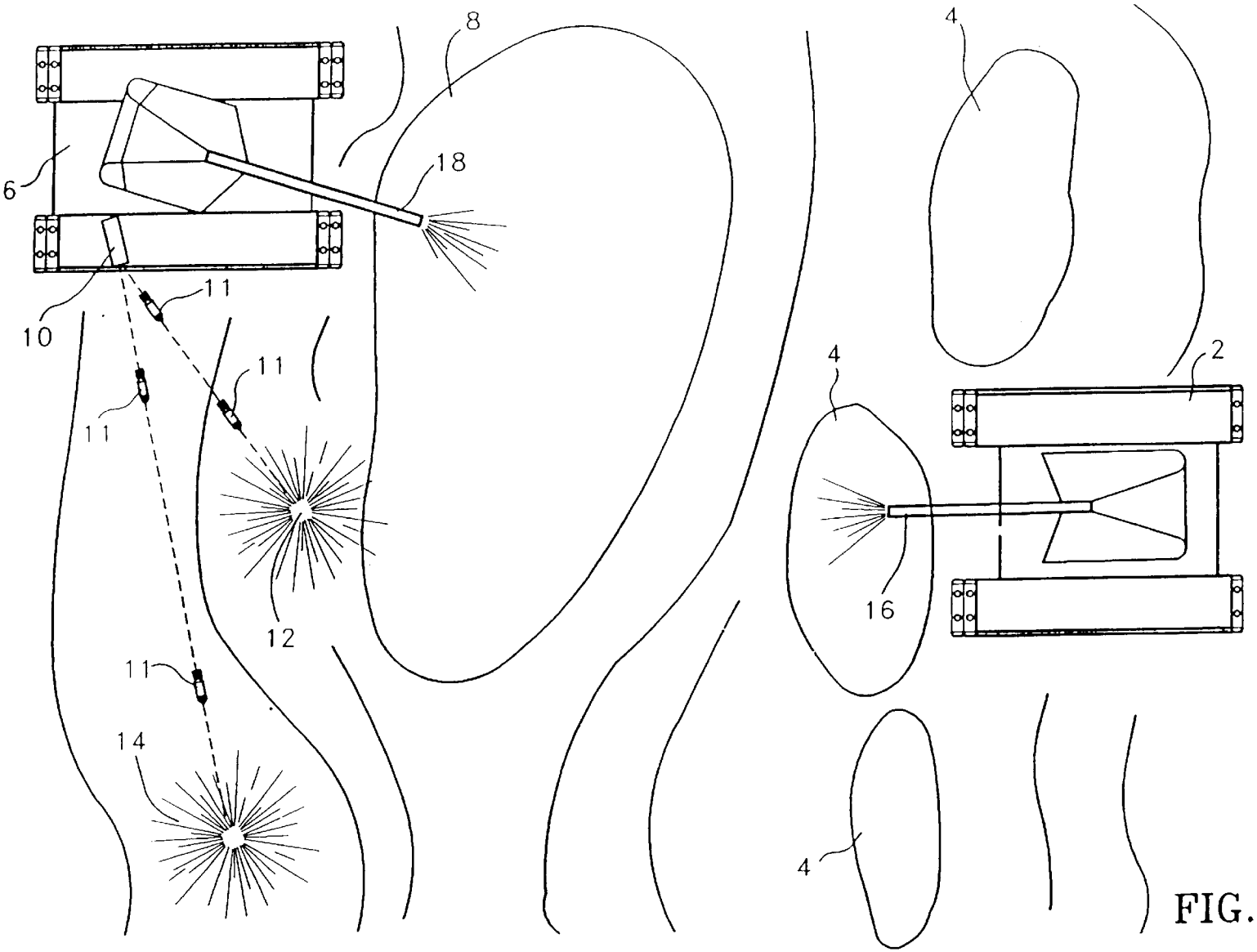
FIGS. 1A and 1B are illustrations of the operation and functionality of a deception system constructed and operative in accordance with a preferred embodiment of the invention.
Figure 1B:
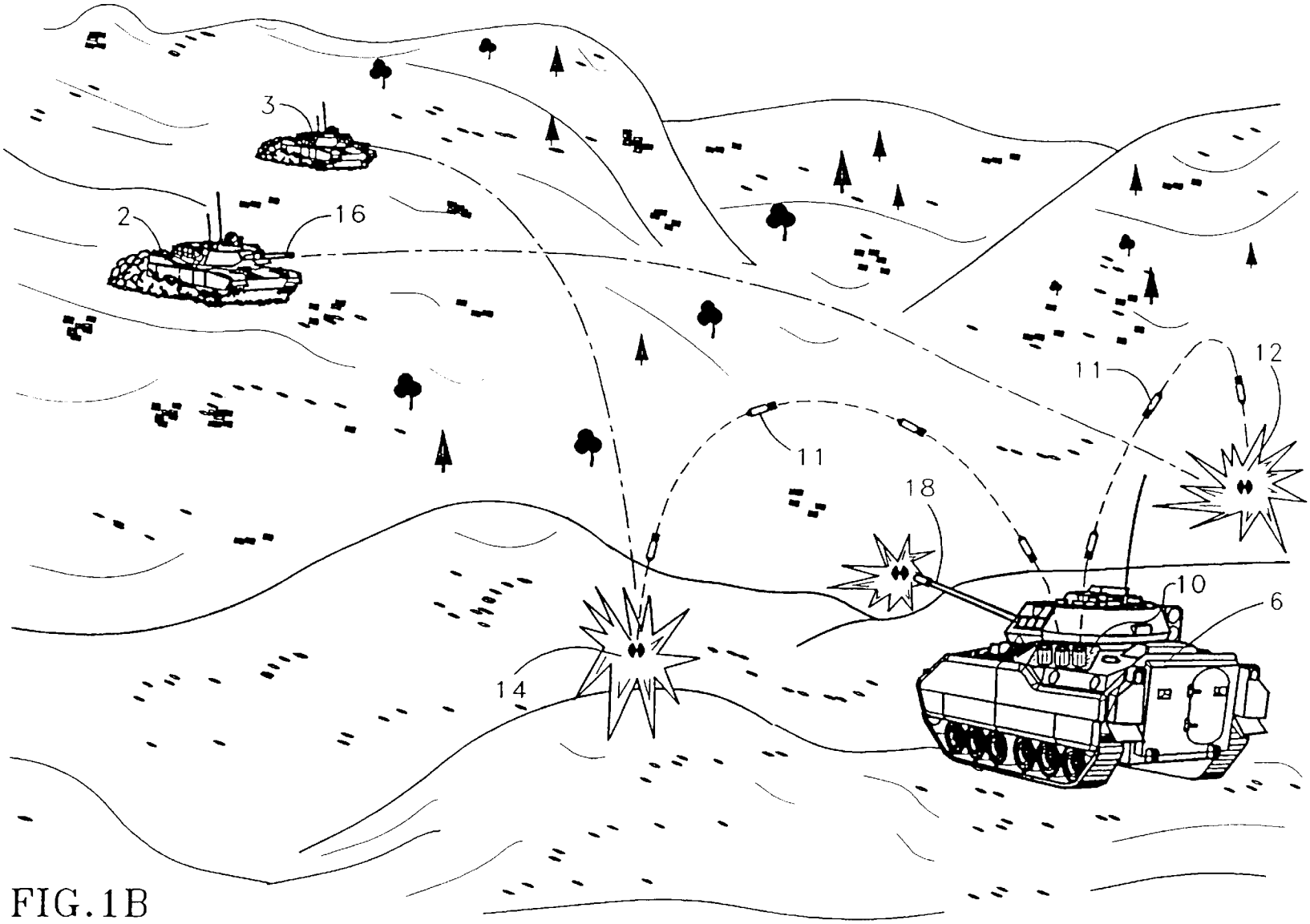

Reference is now made to FIGS. 1A and 1B which together illustrate the operation and functionality of a deception system for deceiving an enemy about the tactical and strategical tendencies of friendly military forces confronting the enemy and about the number and location of the friendly military forces in accordance with a preferred embodiment of the invention.

For the purposes of the present invention the term "friendly" is used throughout the specification and claims to include an army side in a battle which the systems and methods of the present invention come to assist. The term "enemy" is used throughout the specification and claims to include an army side confronting the friendly side. Both terms "friendly" and "enemy" are mentioned in conjunction with armed forces and troops, with infantry and with military systems such as military battle tanks and artillery, armor or armored vehicles, battle ships, airplanes and helicopters.

In battle, military battle tanks 2 and 3, which form part of the enemy armed forces, are positioned behind hills 4 in a fire position and in an observation position respectively. The crews of military battle tanks 2 and 3 seek targets of the friendly army forces which confront them to shoot at.

Typically, the attention of a tank crew is drawn to places at which cannon-gun firing is observed, and usually the tank crew also seeks targets in the vicinity of such places.

A military battle tank 6, which forms part of the friendly army forces, is positioned behind hills 8 in an observation position or in a fire position at a typical battle distance away from the enemy forces. Typical battle distances for tank battles are 2000–3000 meters.

Military battle tank 6 has mounted on board a launcher 10 that launches pyrotechnic ammunition 11 which is detonated at a location away from military battle tank 6 to decoy firing from a tank cannon-gun. In an alternative embodiment of the present invention launcher 10 may be mounted inside the tank turret or tank body so that it is pushed outside the tank turret or the tank body when it is prepared for firing.

For the purposes of the present invention the term "launcher" is used throughout the specification and claims in a broad sense to include any deploying system which may deploy ammunition away from the deploying system.

The term "launch" is used throughout the specification and claims in a broad sense to include any operation, such as ejection, dropping and firing, which may be used with cartridges, bombs, shells, projectiles, rockets and other detonating means in order to deploy the detonating means away from a launcher.

The terms "detonation" and "explosion" are intermittently used throughout the specification and claims to include the blasting of blast materials as well as the detonation of materials such as explosives, pyrotechnic materials and gunpowder.

Throughout the specification and claims the term "ammunition" is used to include any cartridges, shells, projectiles, bombs, rockets and other means which may be deployed in battlefield and contain any type of detonating materials, such as explosives, pyrotechnic materials and gunpowder.

Preferably, launcher 10 may be a conventional mortar such as the mortars which are positioned on board of many military battle tanks, and the pyrotechnic ammunition may be a mortar bomb or part of a mortar bomb. It is to be appreciated that a suitable mortar may be a mortar in which a muzzle flash effect is not created during firing of mortar bombs.

Alternatively, launcher 10 may be one of a dedicated pneumatic ejector, a hydraulic ejector, a dedicated spring operated ejector or a combination thereof.

If launcher 10 is a pneumatic ejector or a hydraulic ejector, pyrotechnic ammunition 11 may be pushed by a piston (not shown) which is operated by air pressure or hydraulic pressure respectively.

If launcher 10 is a spring operated ejector, pyrotechnic ammunition 11 may be pushed by a piston (not shown) which is pushed by a spring (not shown).

In an alternative embodiment of the invention pyrotechnic ammunition 11 may be also pushed by a piston (not shown) which is operated by hydraulic pressure and by a spring or by pneumatic pressure and a spring. In any of these cases, launcher 10 is operative to eject the pyrotechnic ammunition without creating a muzzle flash effect.

It is to be appreciated that launcher 10 may have a plurality of barrels for firing a plurality of pyrotechnic ammunition 11.

In a typical battle scenario pyrotechnic ammunition 11 is exploded at a vacant location 12 which is some distance away from military battle tank 6. Vacant location 12 may be anywhere in the surroundings of military battle tank 6 along battlefield width or depth. In a preferred embodiment of the invention the pyrotechnic ammunition may be also ejected or fired at similar distances in front or at the rear of tank 6.

Typically, the distance at which pyrotechnic ammunition 11 is exploded is 100 meters to 1000 meters away from launcher 10. Preferably, the pyrotechnic ammunition is also exploded at a selected height of 1.00 to 3.00 meters above ground level which is a typical height above ground level of a tank cannon-gun.

When pyrotechnic ammunition 11 is exploded, substantially at vacant location 12 at a typical height above ground level of a tank cannon-gun, enemy gunners attention is drawn to location 12 at which there are no friendly forces. The explosion of pyrotechnic ammunition 11 preferably creates a muzzle flash effect which is similar to a muzzle flash created by firing real, live ammunition by a conventional cannon-gun of a military battle tank. It is thus expected that the muzzle flash effect will be interpreted by enemy gunners as a real military tank which belongs to the friendly forces and is firing at the enemy.

The explosion of pyrotechnic ammunition 11 generates an illusion which may provide the friendly forces with two important benefits:

(a) the enemy thinks that there is a real military tank at a location in which there are no military systems or troops at all, and (b) the enemy gunners think that the illusional tank is aiming at them, and they may therefore take actions in view of that threat, such actions being generally in favor of the friendly military forces.

It is to be appreciated that during the typical short time period of the explosion of pyrotechnic ammunition 11, as well as during the time period of firing live ammunition by a tank cannon-gun, a soldier is not able to observe whether there is a tank silhouette behind the fire ball which characterizes such pyrotechnic ammunition explosion or such live ammunition firing. Thus, an explosion of pyrotechnic ammunition 11 may not be, typically, distinguished from firing of live ammunition.

In an additional firing round, another pyrotechnic ammunition may be fired and exploded at a vacant location 14 which may be separate from vacant location 12. Such explosions at arbitrary spots may create an illusion of many military systems spread in battlefield, which belong to the friendly forces and which participate in the battle.

Due to the reasons described herein above, and due to the general stress conditions and confusion in real battlefields, it is highly probable that the gunners of enemy tanks 2 and 3 are led to aim and fire at locations in which muzzle flash effects are observed, such as at vacant locations 12 and 14.

If the gunner of enemy tank 2 fires towards location 12, the live ammunition fired by cannon-gun 16 of enemy tank 2 does not hit any target. However, the cannon-gun firing from enemy tank 2 creates a muzzle flash which exposes the location of tank 2 and makes it vulnerable to a hit by cannon-gun 18 of tank 6.

Even if the gunner of enemy tank 2 does not shoot at the sight of the explosions of pyrotechnic ammunition 11 at locations 12 or 14, his attention is drawn to these locations and eventually he loses time in trying to distinguish between real tanks and decoys. During that time, enemy tank 2 may be vulnerable to a hit by tank 6.

If the gunner of tank 2 suspects that a muzzle flash is not a result of real firing by a tank cannon-gun, he may use a FLIR (Forward Looking Infrared) system to determine whether there is a tank behind the suspected muzzle flash. However, such action still causes the enemy loss of valuable time.

In order to make deception more realistic it is preferred to combine pyrotechnic ammunition explosions with real cannon-gun-firing. This is achieved by employing a firing procedure in which military battle tank 6 fires at the enemy live ammunition followed by the firing of at least one pyrotechnic ammunition which is exploded at some distance away from tank 6. Alternatively, firing of the pyrotechnic ammunition may precede the firing of live ammunition.

In another preferred embodiment of the present invention crews of some military battle tanks which belong to the friendly forces may fire real ammunition at the enemy while other friendly forces, which may also include crews of other military battle tanks, may fire pyrotechnic ammunition.

In both cases however, the pyrotechnic ammunition is preferably exploded at a selected height above ground level. Preferably, the selected height is a typical height above ground level of a barrel of a tank cannon, generally of the order of 1.00 to 3.00 meters.

It is to be appreciated that the system and method of the present invention may be used not only in battles in which tanks are involved, but may also be employed for deception of enemy forces on land, sea and air.

In accordance with a preferred embodiment of the present invention the explosion of decoys (pyrotechnic ammunition) may deceive enemy tanks as well as enemy airplanes and helicopters in a scenario in which enemy crews or pilots seek targets of the friendly forces to shoot at. In that case pyrotechnic ammunition 11 may be fired from any friendly military vehicle such as a military battle tank, a land armored vehicle, a military truck and an artillery carrying vehicle. In the case where an enemy airplane or an enemy helicopter is involved, the airplane or helicopter takes the role of enemy tank 2 in the above mentioned battle scenario.

In another preferred embodiment of the present invention launcher 10 may be a portable launcher which is carried by a friendly infantry soldier, such as a 52 millimeter caliber mortar, and pyrotechnic ammunition 11 may be a 52 millimeter caliber mortar bomb or a part of a mortar bomb thereof. In such a case, launcher 10 is operated by the friendly infantry soldier which may launch pyrotechnic ammunition 11 to deceive at least one of enemy infantry, enemy land vehicles, such as tanks and armored vehicles, airplanes and helicopters.

It is to be appreciated that launcher 10 may be any type of conventional ammunition launcher. The term "conventional ammunition launcher" is used throughout the specification and claims to include any known existing launcher such as a smoke ammunition launcher, a bomb launcher, a rocket launcher, a grenade launcher and a cannon-gun launcher.

In a preferred embodiment of the present invention the conventional ammunition launcher is adapted to launch pyrotechnic ammunition 11. Alternatively, the pyrotechnic ammunition is adapted for use with a conventional ammunition launcher.

In another preferred embodiment of the present invention pyrotechnic ammunition 11 may be employed to create a deception effect other than a muzzle flash effect of a tank cannon-gun. In such a case the effect of an explosion of the pyrotechnic ammunition may be similar to a rocket launch, firing of a heavy mortar, artillery firing and firing other cannon-guns, such as ship mounted cannon-guns, airplane mounted cannon-guns and helicopter mounted cannon-guns.

The system and method of the present invention may be also employed to deceive enemy battle ships which are firing at coasts where friendly forces are deployed. In such a case an enemy battle ship takes the role of enemy military battle tank 2, and marine gunners take the role of enemy tank 2 gunner in the above mentioned battle scenario.

In another preferred embodiment of the invention, battle ships of the friendly forces may deceive enemy airplanes, battle ships, and ground troops in a battle scenario where friendly battle ships are firing at enemy coasts.

In such a case, friendly battle ships may fire a plurality of pyrotechnic ammunition at locations surrounding the friendly battle ships at an acceptable distance away from the friendly battle ships to deceive the enemy. Preferably, each of the plurality of pyrotechnic ammunition is exploded above sea level at a typical height above sea level of a ship cannon or a ship launcher.

In yet another preferred embodiment of the invention airplanes and helicopters of the friendly forces may launch pyrotechnic ammunition as described herein above, at vacant areas to attract enemy attention to places where there are no friendly forces at all.

In accordance with a preferred embodiment of the invention, when an explosion of the pyrotechnic ammunition is employed to decoy firing from a military system other than a battle tank, the explosion height is selected to match the height of the military system which the pyrotechnic ammunition is employed to decoy.

It is to be appreciated that the system of the present invention may be also employed for training. In such a case an enemy side may be simulated by explosions of pyrotechnic ammunition. A friendly side may be trained to shoot at locations in which explosions of pyrotechnic ammunition are observed.

Preferably, the pyrotechnic ammunition may be fired by trainers, and set to explode at a distance of approximately 1000 meters from the trainers. Thus, when training forces are firing live ammunition, the trainers are not endangered.

Figure 2:
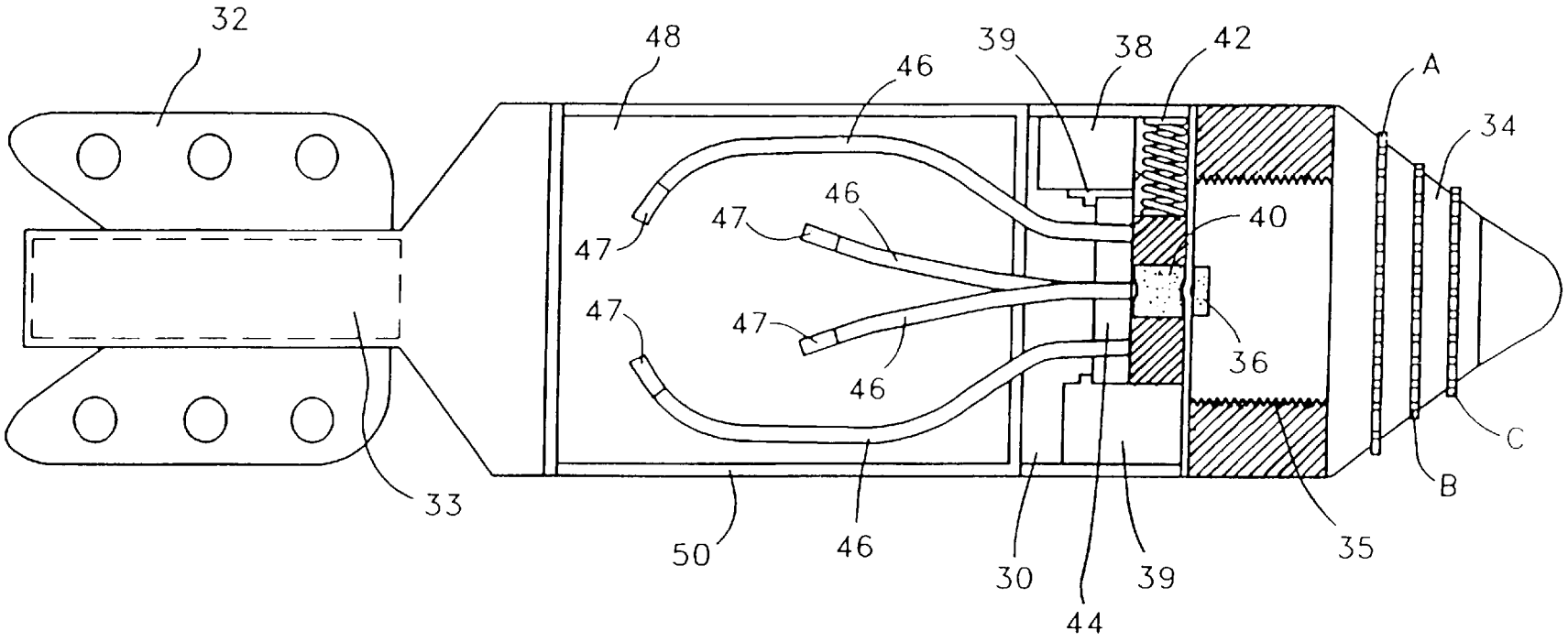
FIG. 2 is an illustration of pyrotechnic ammunition which forms part of the deception system of FIGS. 1A and 1B constructed and operative in accordance with a preferred embodiment of the invention.

Reference is now made to FIG. 2 which illustrates pyrotechnic ammunition, such as pyrotechnic ammunition 11 of FIGS. 1A and 1B, which forms part of a deception system constructed and operative in accordance with a preferred embodiment of the invention.

The pyrotechnic ammunition of FIG. 2 includes a body structure 30, a tail structure 32 and a detonation mechanism 34 which is mounted at a front end of the pyrotechnic ammunition.

In the embodiment where the pyrotechnic ammunition forms part of a mortar bomb, tail structure 32 includes a cartridge 33. In the embodiment where the pyrotechnic ammunition is ejected by a spring from a spring operated launcher, or by a piston from a hydraulic or pneumatic launcher, tail structure 32 may be an inert, rigid structure.

Detonation mechanism 34 includes a time delay mechanism which is preset by a soldier before firing, or set during flight of the pyrotechnic ammunition.

Setting of detonation mechanism 34 may be obtained prior to the firing of the pyrotechnic ammunition by rotating thumb wheels indicated as "A", "B" and "C" in accordance with an estimation of time of flight of the pyrotechnic ammunition. Preferably, each of the thumb wheels A, B and C sets a time period of different scales, such as a 10 seconds scale, a 1 second scale and a 0.1 second scale respectively.

In the case that detonation mechanism 34 is set during flight, a processor (not shown) may receive as input the angle at which the pyrotechnic ammunition is fired and compute the time at which the pyrotechnic ammunition is to be exploded.

In a preferred embodiment of the present invention the pyrotechnic ammunition is detonated after the estimated time of flight, which has been computed by the processor or set by the thumb wheels, has elapsed. Preferably, the time of flight is estimated so as to enable the pyrotechnic ammunition to detonate at a height of 1.00 to 3.00 meters above ground.

Alternatively, detonation mechanism 34 may include a height mechanism which is set by thumb wheels (not shown) to explode at a pre-selected height above ground, or at a height which is computed by a processor (not shown) during flight of the pyrotechnic ammunition.

In a preferred embodiment of the present invention detonation mechanism 34 is threaded, by means of a thread 35, into an orifice (not shown) in the front end of the ammunition. Preferably, the above mentioned time delay mechanism or height mechanism is mounted in the inner part of detonation mechanism 34 and is operative to detonate a detonator 36 at a preselected time after launch or at a preselected height above ground level respectively.

Detonation mechanism 34 may also include an arming mechanism 38. In a preferred embodiment of the present invention, detonation mechanism 34 is not armed before launching the pyrotechnic ammunition. After launch, and during flight, arming mechanism 38 is operative to arm the pyrotechnic ammunition.

Arming mechanism 38 may be fixed in a position by clamping units 39. Arming mechanism 38 is operative to slide a detonator 40, by means of a spring 42 which is released after launch, to a position between detonator 36 and a detonator 44.

When detonator 40 is positioned between detonator 36 and detonator 44, a continuous detonation chain, which includes detonators 36, 40 and 44, is formed and the pyrotechnic ammunition is armed.

Prior to flight, detonator 40 is positioned away from detonators 36 and 44 and the detonation chain, formed by detonators 36 and 44 is not continuous. In such a case, an accidental explosion of detonator 36 does not cause an explosion of detonator 44 and the pyrotechnic ammunition is secured.

This feature of keeping the pyrotechnic ammunition secured before flight, and arming it during flight, is part of a detonation secure system which is employed to prevent casual and unplanned explosions of the pyrotechnic ammunition.

In a preferred embodiment of the present invention, detonation fuses 46 are inserted into holes in detonator 44 to keep the continuity of the detonation chain. Alternatively, detonation fuses 46 may be coupled by any conventional means to the surface of detonator 44, such as by clamps (not shown).

Detonators 36, 40 and 44 form a detonation chain which ignites detonation fuses 46 that are spread in body 30 of the pyrotechnic ammunition. Detonation fuses 46 ignite a main pyrotechnic explosive material 48 which explodes to create a muzzle flash effect as described hereinabove with reference to FIG. 1. Preferably, pyrotechnic explosive material 48 is contained in a container 50.

It is to be appreciated that pyrotechnic explosive material 48 may be similar to blasting material which is used in launching live ammunition. Typically, pyrotechnic explosive material 48 may include gun-powder. However, other suitable blasting material may be employed.

Ends 47 of detonation fuses 46 which are not inserted into the holes in detonator 44 may be clamped to avoid disintegration of burning powder or explosive material present within detonation fuses 46.

Detonation fuses 46 are preferably surrounded by main pyrotechnic explosive material 48 in container 50 so that a detonation of main pyrotechnic explosive material 48 is initiated at many points at the same time. Therefore, the explosion of the pyrotechnic ammunition is symmetric and has no preferred direction.

Such an explosion is typically seen by an observer as a fire-ball regardless of the view angle at which the explosion is viewed. Thus, the explosion may be interpreted by an observer as cannon-gun firing which is directed at him regardless of the distance between the explosion point and the observer or the view angle at which the observer sees the explosion of the pyrotechnic ammunition.

In another preferred embodiment of the invention the pyrotechnic ammunition may be employed as a decoy which creates a hit and kill effect to make the enemy believe that friendly forces systems are hit although they are not. In that case pyrotechnic explosive material 48 may be substituted by a pyrotechnic explosive material which includes smoke generation material as well as gun-powder and creates a fire and smoke effect as well as an explosion effect.

In accordance with a preferred embodiment of the invention, the pyrotechnic ammunition which creates the hit/kill effect may be deployed from any kind of military vehicles, such as military battle tanks, artillery, heavy armor, battle ships, airplanes and helicopters. Alternatively, such pyrotechnic ammunition may be deployed by an infantry soldier. Preferably, the pyrotechnic ammunition is fired towards vacant locations.

It will be appreciated by persons skilled in the art that the present invention is not limited by what has been particularly shown and described hereinabove. Rather the scope of the present invention is defined only by the claims which follow:

I claim:

1. A deception system for deceiving enemy forces comprising:

a launcher; and pyrotechnic ammunition which is launched from said launcher and exploded at a pre-selected height above ground at a location away from the launcher, the pyrotechnic ammunition including:

a detonation mechanism which is set to detonate at said pre-selected height above ground at said location away from the launcher; and a pyrotechnic explosive material comprising a blasting material which is used in launching live ammunition, wherein said pyrotechnic explosive material is detonated by said detonation mechanism, and a detonation of said pyrotechnic explosive material is operative to create a muzzle flash effect which is substantially similar to an actual muzzle flash created in a live fire round from an actual military weapon.

2. A system according to claim 1 and wherein said muzzle flash effect is employed to decoy an enemy.

3. A system according to claim wherein said pyrotechnic explosive material is a main pyrotechnic explosive material.

4. A system according to claim 1 and wherein said pre-selected height is substantially similar to a height above ground of a launching barrel of an actual military weapon which said pyrotechnic ammunition is employed to decoy.

5. A system according to claim 1 and wherein said launcher is mounted on a military vehicle.

6. A system according to claim 5 and wherein said military vehicle comprises one of a military battle tank, an artillery carrying vehicle, a land armored vehicle, a ship, an airplane and a helicopter.

7. A system according to claim 1 and wherein said launcher is a portable launcher which is carried by a soldier.

8. A system according to claim 1 and wherein said launcher includes a launching mechanism which does not create an actual muzzle flash during launch of said pyrotechnic ammunition.

9. A system according to claim 1 and wherein said launcher is one of a grenade launcher, a rocket launcher, a smoke ammunition launcher, a cannon-gun launcher and a bomb launcher which is adapted to launch said pyrotechnic ammunition.

10. A system according to claim 1 and wherein said pyrotechnic ammunition is adapted to be launched from one of a grenade launcher, a rocket launcher, a smoke ammunition launcher, a cannon-gun launcher and a bomb launcher.

11. A system according to claim 1 and wherein said detonation mechanism is a time mechanism which is set to detonate at said selected height above ground by estimation of time of flight of said pyrotechnic ammunition.

12. A system according to claim 1 and wherein said detonation mechanism is a height mechanism which is set to detonate at said selected height above ground by setting a selected explosion height.

13. A system according to claim 1 and wherein said muzzle flash effect is employed to decoy cannon-gun firing.

14. A system according to claim 1 and wherein an explosion of the pyrotechnic ammunition is symmetric and has no preferred direction.

15. A system according to claim 1 and wherein said pyrotechnic ammunition includes at least one detonation fuse which is operable to substantially simultaneously ignite said pyrotechnic explosive material at more than one point to create a substantially symmetric explosion.

16. A system according to claim 1 and wherein said blasting material which is used in launching live ammunition comprises gun-powder.

17. A system according to claim 1 and wherein said launcher comprises a mortar and said pyrotechnic ammunition comprises at least part of a mortar bomb.

18. A system according to claim 1 and wherein said launcher comprises a plurality of launching barrels for launching a plurality of said pyrotechnic ammunition.

19. A system according to claim 1 and wherein said detonation mechanism is a time mechanism which is set to detonate at said pre-selected height above ground at said location away from the launcher by estimation of time of flight of said pyrotechnic ammunition.

20. A system according to claim 1 and wherein said pyrotechnic ammunition also comprises an arming device.

21. A deception system for deceiving enemy forces comprising:

a launcher comprising one of a pneumatic mechanism, a hydraulic mechanism and a spring mechanism; and pyrotechnic ammunition which is launched from said launcher and exploded at a location away from the launcher, the pyrotechnic ammunition including:

a detonation mechanism which is set to detonate at said location away from the launcher; and a pyrotechnic explosive material comprising a blasting material which is used in launching live ammunition, wherein said pyrotechnic explosive material is detonated by said detonation mechanism, and a detonation of said pyrotechnic explosive material is operative to create a muzzle flash effect which is substantially similar to an actual muzzle flash created in a live fire round from an actual military weapon.

22. A method for deceiving enemy forces comprising:

launching pyrotechnic ammunition from a launcher; and exploding said pyrotechnic ammunition at a selected height above ground at a location away from said launcher, said exploding including:

setting a detonation mechanism to detonate at said selected height above ground at said location away from the launcher; and detonating a pyrotechnic explosive material that comprises a blasting material which is used in launching live ammunition by employing said detonation mechanism, wherein a detonation of said pyrotechnic explosive material is operative to create a muzzle flash effect which is substantially similar to an actual muzzle flash created in a live fire round from an actual military weapon.

23. A method according to claim 22 and also comprising employing said muzzle flash effect to decoy an enemy.

24. A method according to claim 22 and wherein said launching step includes the step of actuating a launching mechanism which is operative to launch said pyrotechnic ammunition substantially without creating an actual muzzle flash during launch of said pyrotechnic ammunition.

25. A method according to claim 22 and wherein said setting includes:

estimating time of flight of said pyrotechnic ammunition; and employing the estimated time of flight to activate said detonation mechanism when said time of flight elapses.

26. A method according to claim 22 and comprising:

maintaining said pyrotechnic ammunition unarmed prior to said launching; and arming said pyrotechnic ammunition after said launching and prior to said exploding.

27. A method according to claim 22 and wherein said blasting material which is used in launching live ammunition comprises gun-powder.

28. A method according to claim 22 and also including the step of firing live ammunition at one of a time before, during and a time after said exploding step.

29. A method for deceiving enemy forces comprising: launching pyrotechnic ammunition from a launcher; and exploding said pyrotechnic ammunition at a height which is substantially similar to a height above ground of a launching barrel of an actual military weapon which said pyrotechnic ammunition is employed to decoy, said exploding including:

setting a detonation mechanism to detonate at said height which is substantially similar to a height above ground of a launching barrel of an actual military weapon; and detonating a pyrotechnic explosive material that comprises a blasting material which is used in launching live ammunition by employing said detonation mechanism, wherein a detonation of said pyrotechnic explosive material is operative to create a muzzle flash effect which is substantially similar to an actual muzzle flash created in a live fire round from an actual military weapon.

30. A method for deceiving enemy forces comprising:

launching pyrotechnic ammunition from a launcher; and exploding said pyrotechnic ammunition at a location away from said launcher, said exploding including:

setting an explosion height;

activating a detonation mechanism when said pyrotechnic ammunition reaches said explosion height; and detonating a pyrotechnic explosive material that comprises a blasting material which is used in launching live ammunition by employing said detonation mechanism, wherein a detonation of said pyrotechnic explosive material is operative to create a muzzle flash effect which is substantially similar to an actual muzzle flash created in a live fire round from an actual military weapon.

31. A deception system for deceiving enemy forces comprising:

a launcher; and pyrotechnic ammunition which is launched from said launcher and exploded at a pre-selected height above ground at a location away from the launcher, the pyrotechnic ammunition including:

a detonation mechanism which is set to detonate at said pre-selected height above ground at said location away from the launcher; and a pyrotechnic explosive material comprising a smoke generation material, a fire generation material, and an explosive material, wherein said pyrotechnic explosive material is detonated by said detonation mechanism, and a detonation of said pyrotechnic explosive material is operative to create a combined fire, smoke, and explosion effect which is employed to decoy hit and kill of an actual military weapon system.

32. Pyrotechnic ammunition to be launched by a launcher comprising:

a detonation mechanism which is set to detonate when said pyrotechnic ammunition is at a pre-selected height above ground at a location away from the launcher; and a pyrotechnic explosive material comprising a blasting material which is used in launching live ammunition, wherein said pyrotechnic explosive material is detonated by said detonation mechanism, and a detonation of said pyrotechnic explosive material is operative to create a muzzle flash effect which is substantially similar to an actual muzzle flash created in a live fire round from an actual military weapon.

33. A method for deceiving enemy forces comprising:

launching pyrotechnic ammunition from a launcher; and exploding said pyrotechnic ammunition at a pre-selected height above ground at a location away from said launcher, said exploding including:

setting a detonation mechanism to detonate at said pre-selected height above ground at said location away from the launcher; and detonating a pyrotechnic explosive material which includes a smoke generation material, a fire generation material, and an explosive material, wherein said pyrotechnic explosive material is detonated by said detonation mechanism, and a detonation of said pyrotechnic explosive material is operative to create a combined fire, smoke, and explosion effect which is employed to decoy hit and kill of an actual military weapon system.

* * * * *